US005788571A

United States Patent [19]

Ivison et al.

[11] Patent Number: 5,788,571

[45] Date of Patent: Aug. 4, 1998

[54] METHOD OF VENTING SMOKE FROM HIGHRISE RESIDENTIAL BUILDINGS

[76] Inventors: John T. Ivison, 305 - 6060 East Boulevard, Vancouver, British Columbia; Murray A. Currie-Johnson, 212 - 5th Avenue, New Westminster, British Columbia, both of Canada, V3L 1R4

[21] Appl. No.: 786,294

[22] Filed: Jan. 22, 1997

[51] Int. Cl.[6] ..... F24F 7/06

[52] U.S. Cl. ..... 454/252; 454/249; 454/338; 454/342

[58] Field of Search ..... 454/239, 242, 454/244, 249, 252, 338, 342

[56] References Cited

U.S. PATENT DOCUMENTS

| | | | |
|---|---|---|---|
| 4,058,253 | 11/1977 | Munk et al. | 454/342 X |
| 4,765,231 | 8/1988 | Aniello | 454/342 X |
| 4,944,216 | 7/1990 | McCutchen | 454/342 |

FOREIGN PATENT DOCUMENTS

| | | | |
|---|---|---|---|
| 59-125342 | 7/1984 | Japan | 454/342 |
| 62-138633 | 6/1987 | Japan | 454/249 |
| 2 138 934 | 10/1984 | United Kingdom | 454/342 |

*Primary Examiner*—Harold Joyce
*Attorney, Agent, or Firm*—Seed and Berry LLP

[57] ABSTRACT

In highrise residential buildings, venting to remove smoke from corridors is required in case of fire. A method of venting smoke from a multi-floor building by providing a single supply and exhaust venting shaft communicating with each floor, with an air supply and exhaust grille opening into each corridor and communicating with the venting shaft; providing a supply source of pressurized air, and an exhaust source of reduced pressure each communicating with the venting shaft, and damper means for selectively closing or opening the communication of the supply source of pressurized air and exhaust source of reduced pressure to the venting shaft. Under normal conditions where pressure is desired in the corridors, the supply source is operating and the communication of the supply source is open to the venting shaft and the exhaust source communication to the venting shaft is closed. In case of a fire where venting of smoke or air is desired in at least one of the corridors is desired, the exhaust source is activated and communication of the exhaust source to the venting shaft is opened and supply source communication to the venting shaft is closed.

2 Claims, 9 Drawing Sheets

PEI System – Exhaust mode

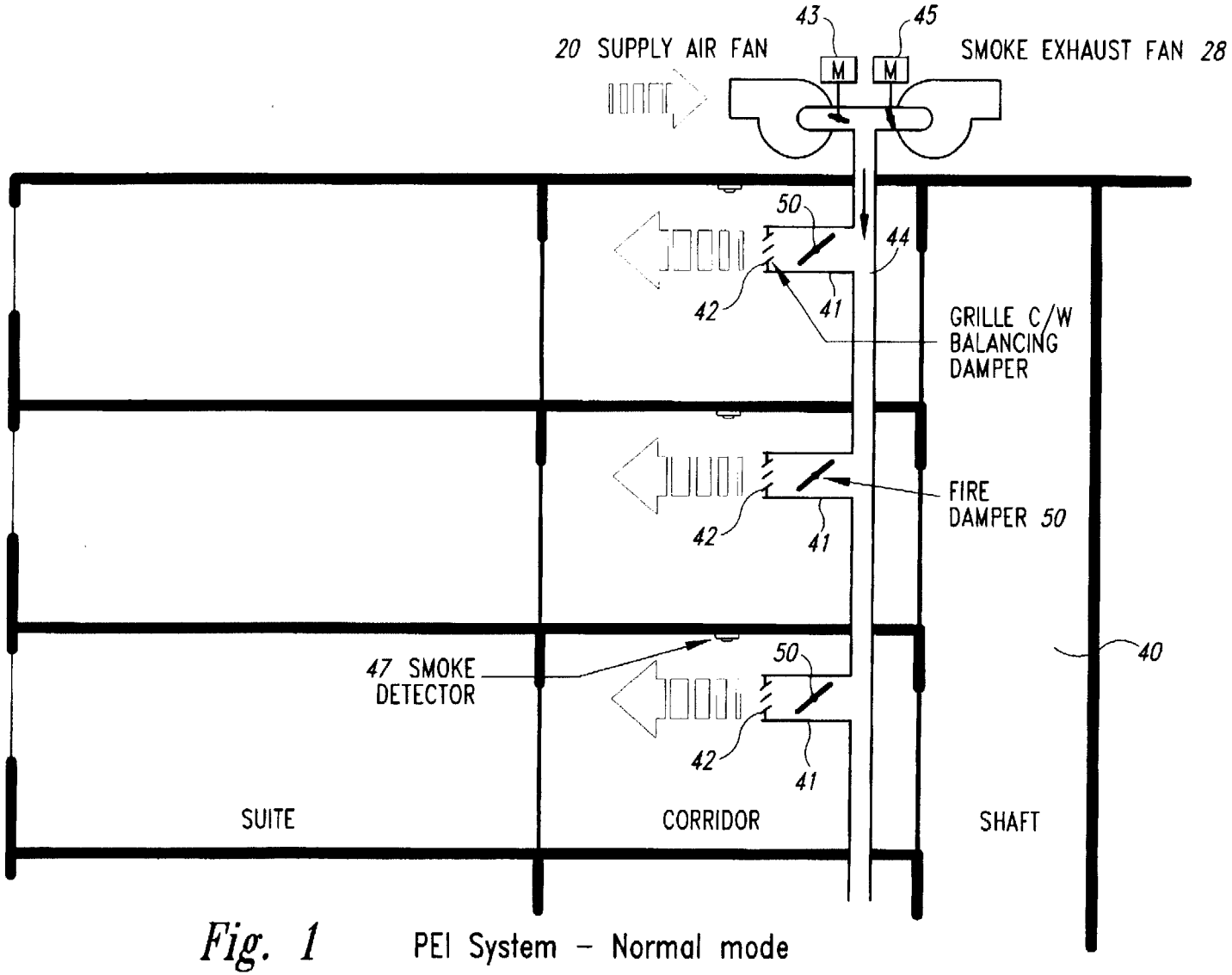
*Fig. 1* PEI System – Normal mode

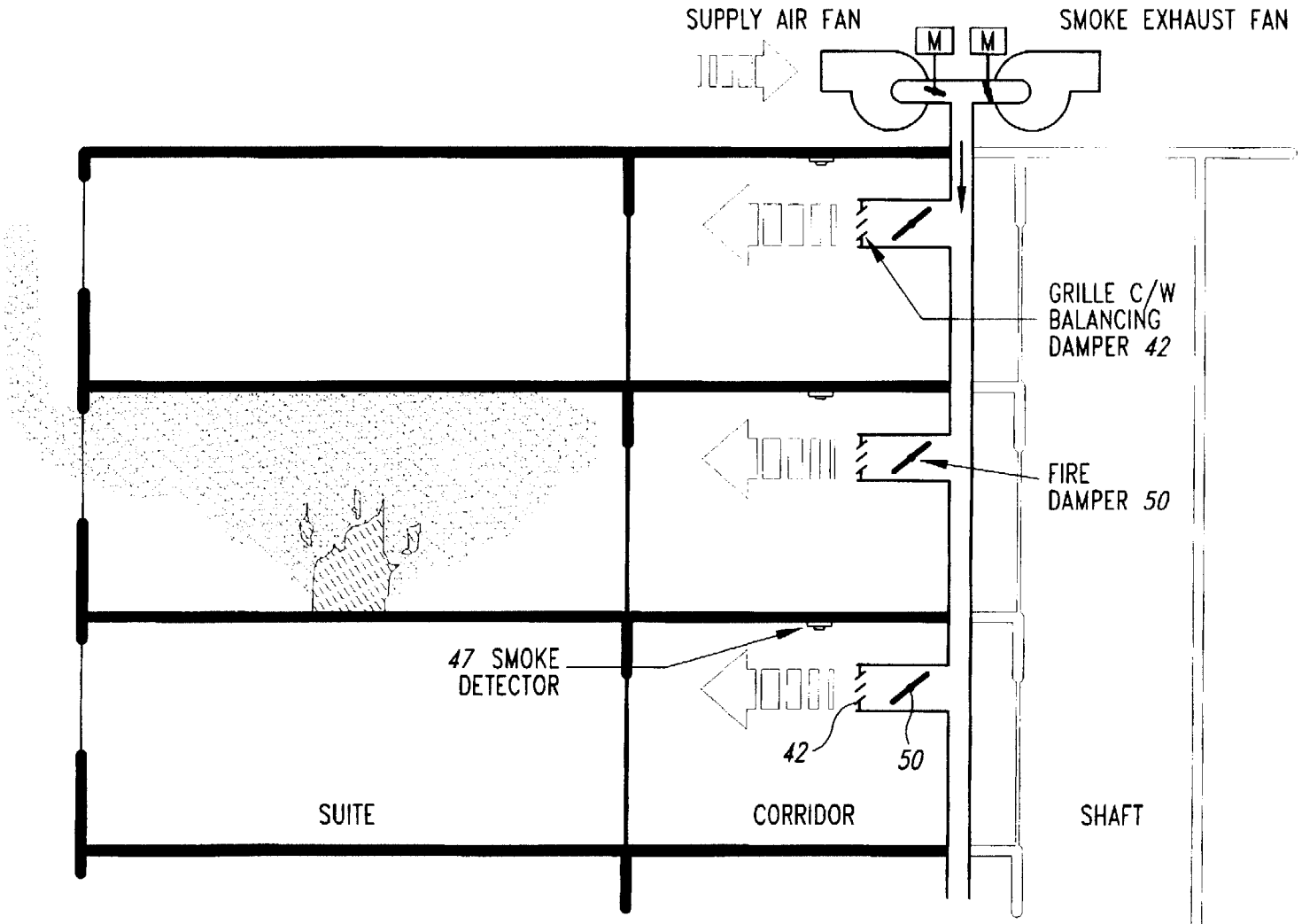
Fig. 2 PEI System – Pressurization mode

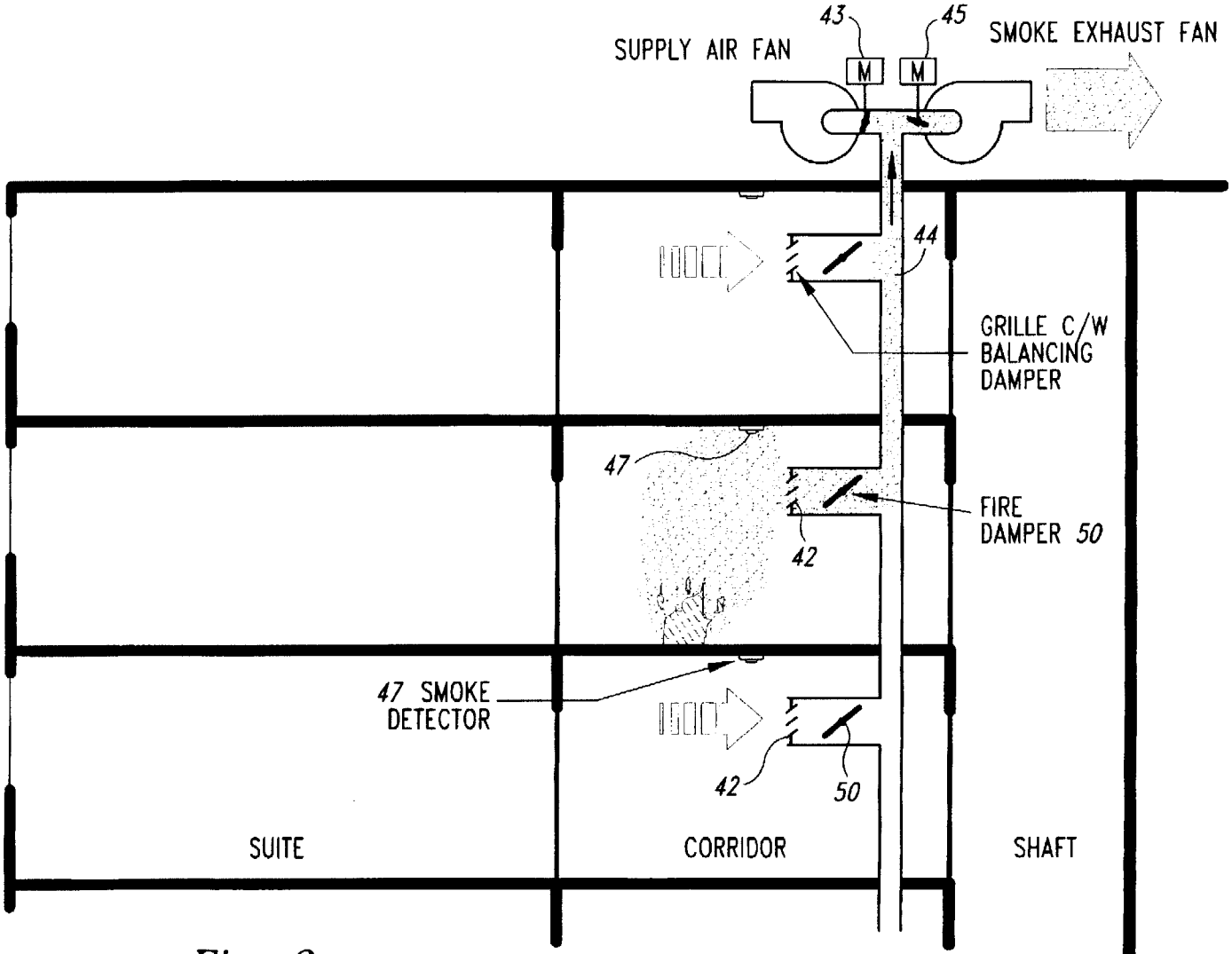
Fig. 3 PEI System – Exhaust mode

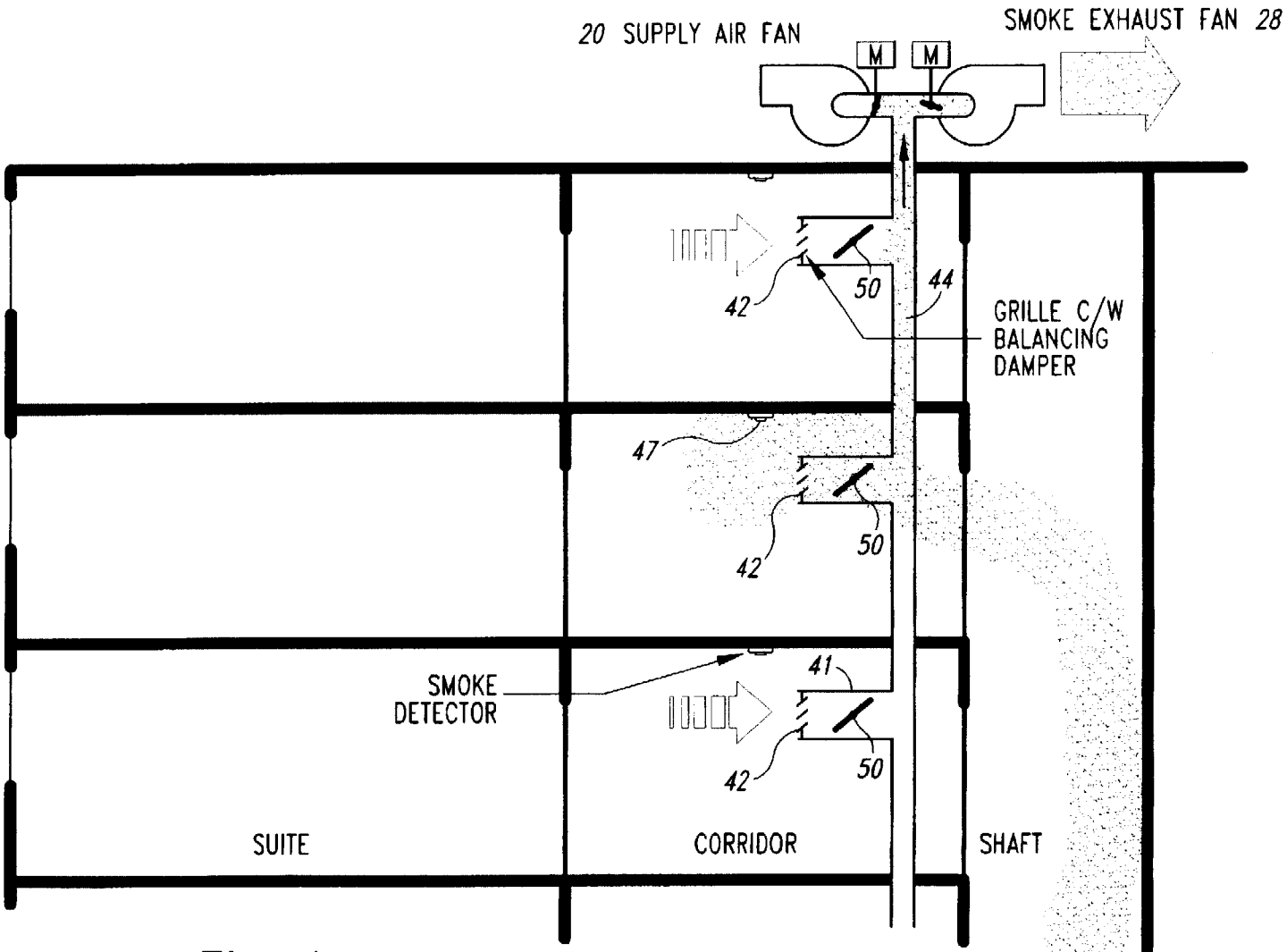
Fig. 4 PEI System – smoke in shaft

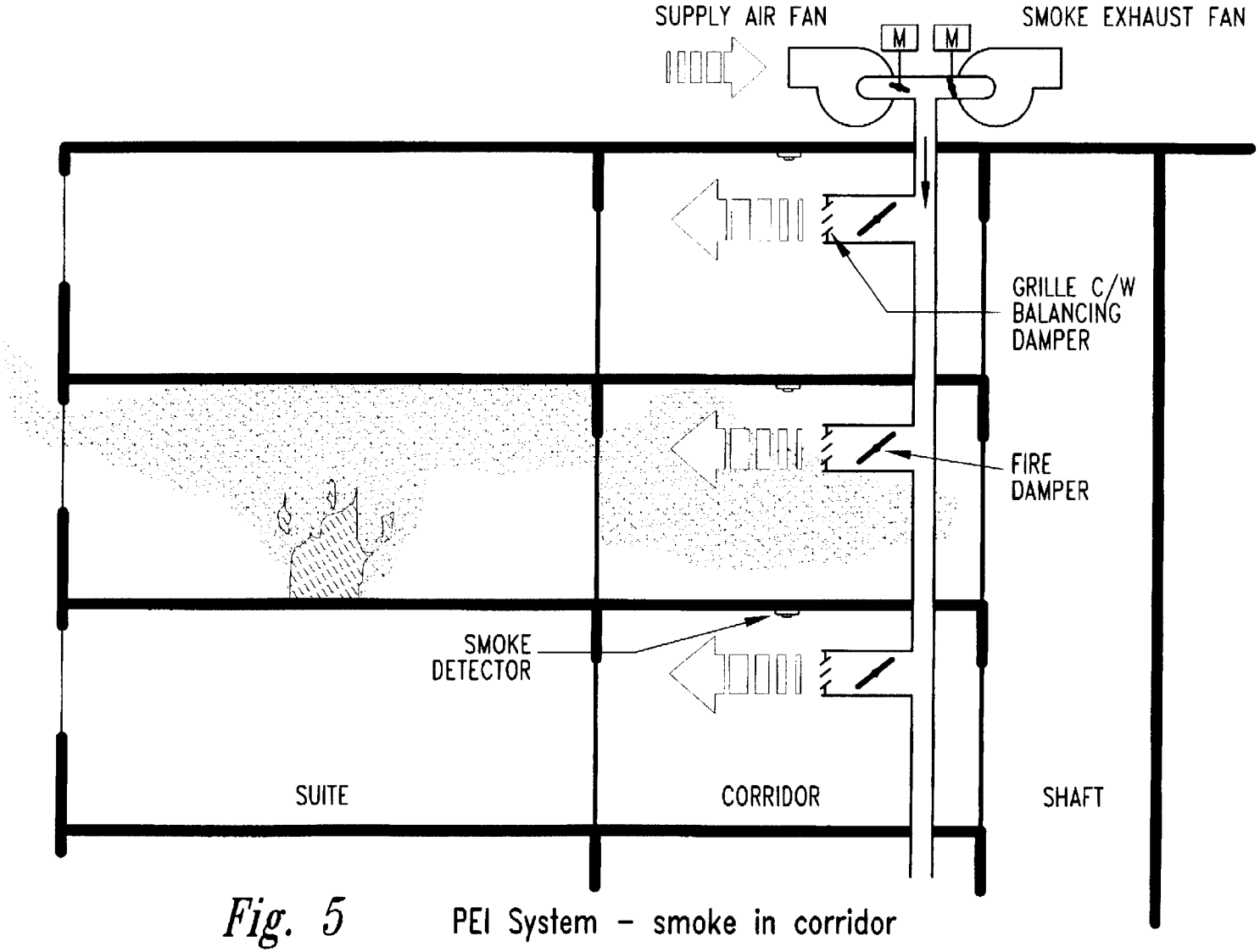
*Fig. 5* PEI System - smoke in corridor

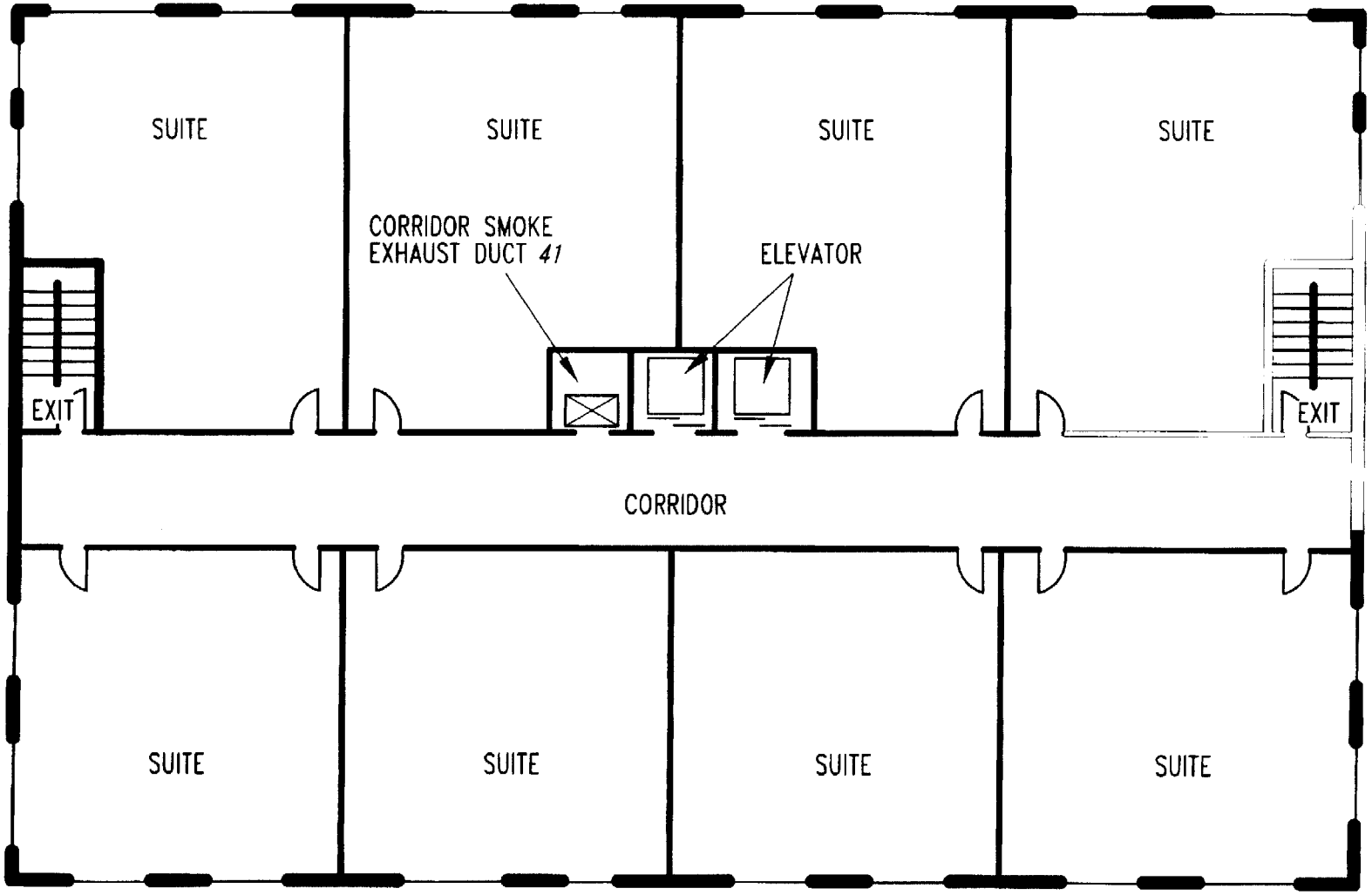
*Fig. 6* Typical corridor layout

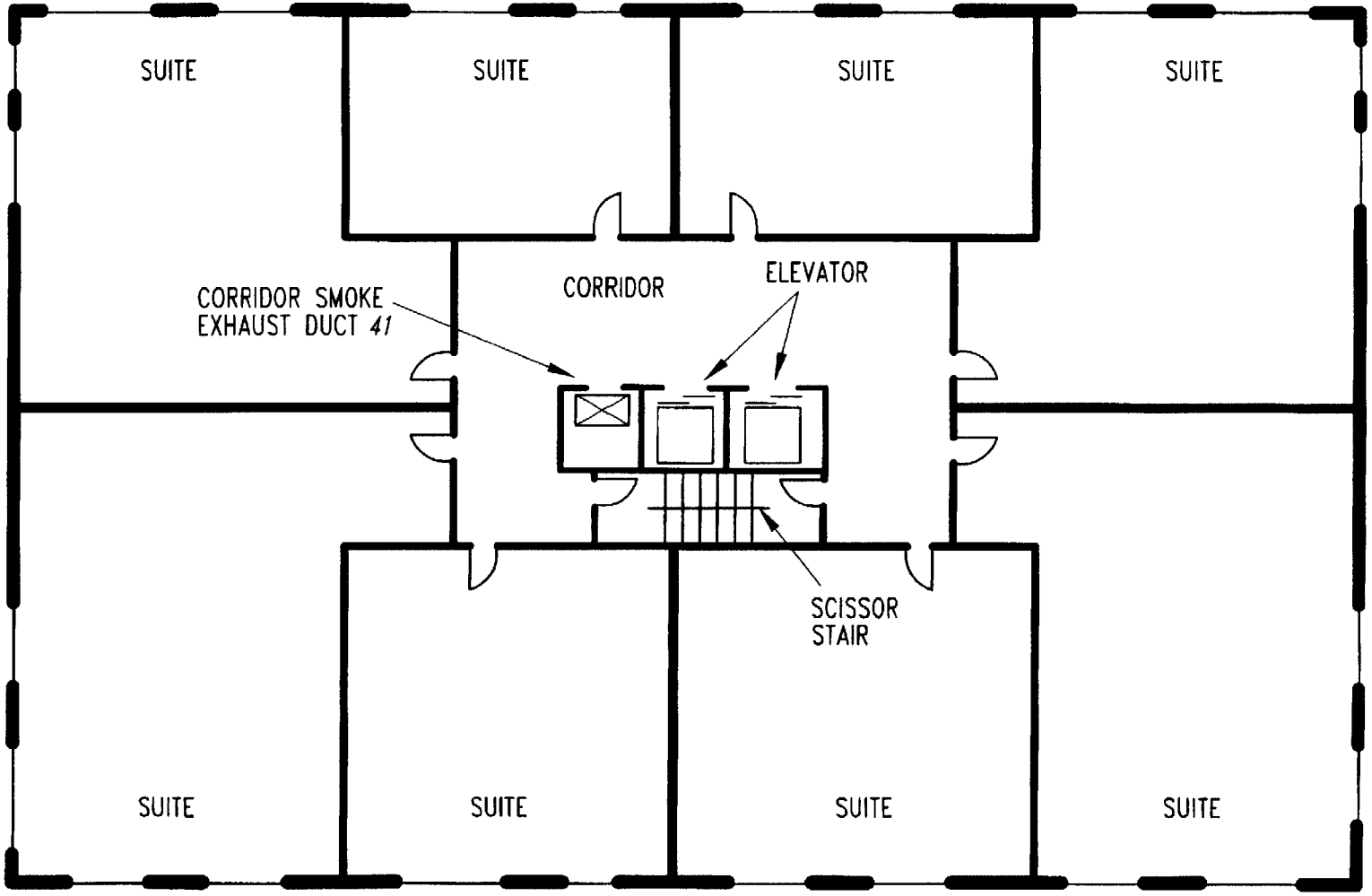
Fig. 7 Typical central core floor plan

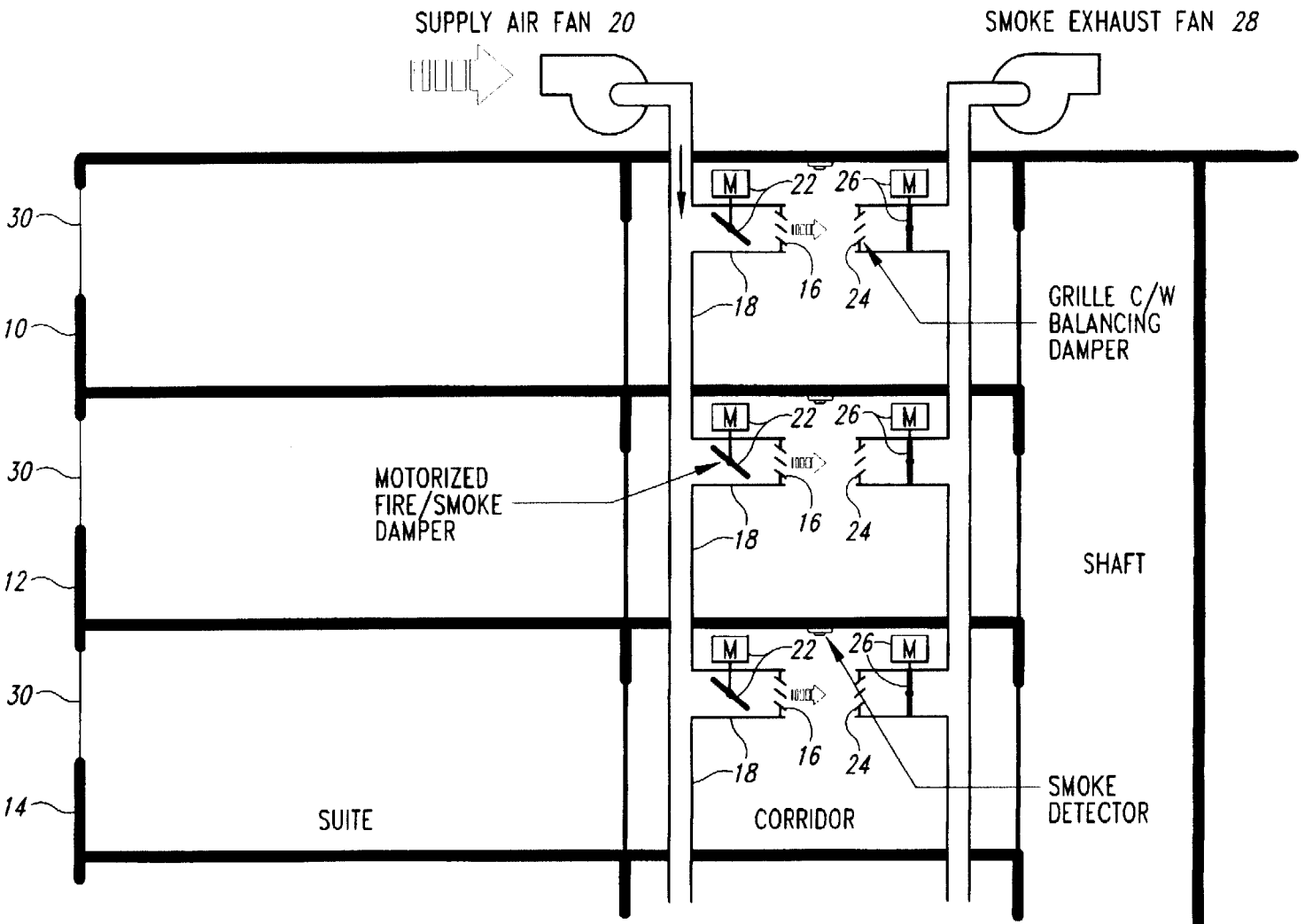
Fig. 8 Conventional System - Supply mode

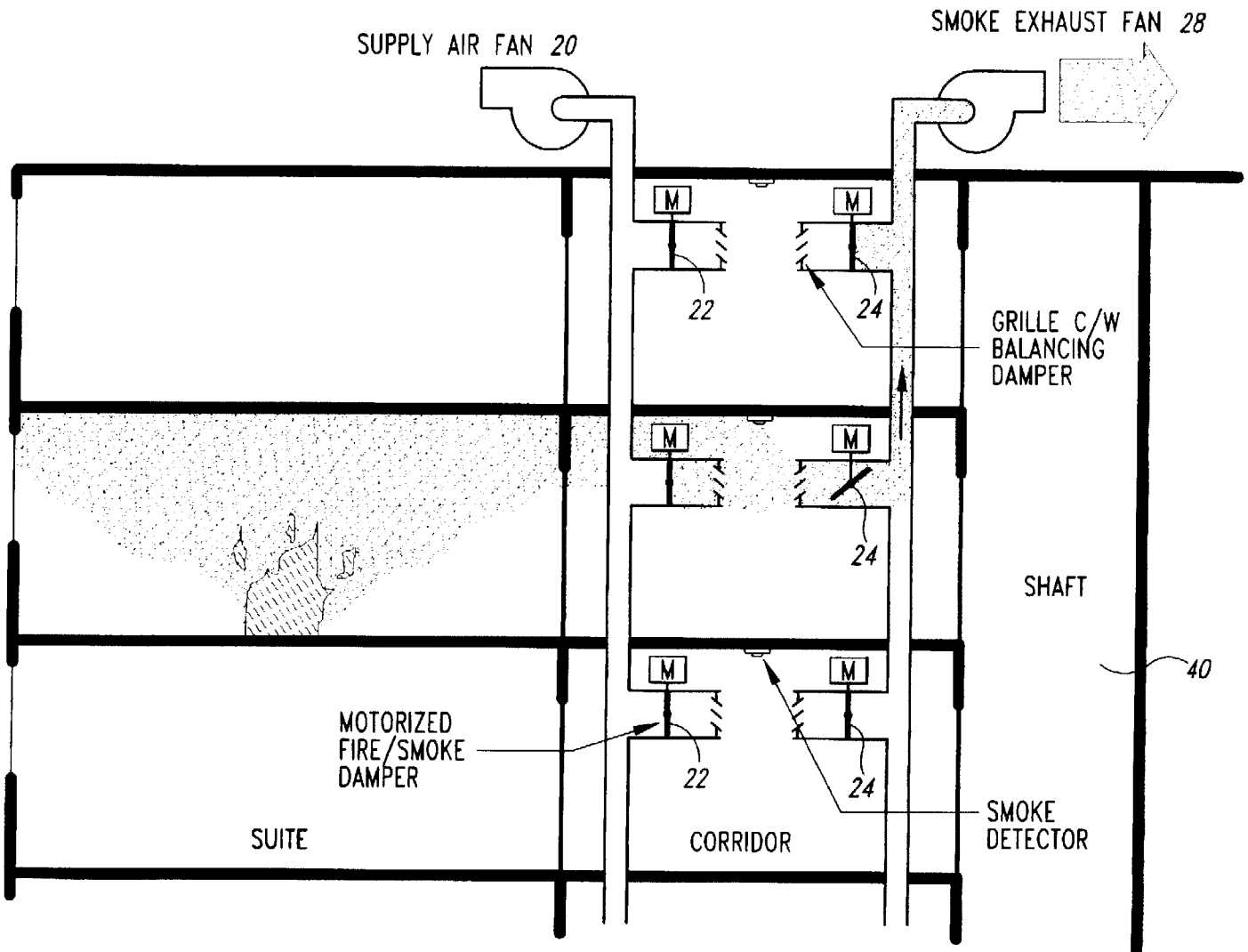
*Fig. 9* Conventional System - Exhaust mode

METHOD OF VENTING SMOKE FROM HIGHRISE RESIDENTIAL BUILDINGS

TECHNICAL FIELD

The invention relates to methods for removing smoke from highrise residential buildings in the event of a fire. More particularly the invention relates to a method for removing smoke from highrise residential buildings by supplying or exhausting air through a common duct connected to the building corridors.

BACKGROUND

Building codes generally require that highrise buildings have a system capable of removing smoke caused by a fire. Removal of smoke from corridors is important both as part of the firefighting smoke purging operations generally and to assist firefighters by improving visibility so that the location of the fire can be determined and the fire extinguished.

In highrise residential buildings, venting to remove smoke is largely achieved through openable windows. Within internal corridors, where there are no external openable windows, venting of smoke can be effected through the building air handling system. In prior art systems, separate supply and exhaust shafts are provided and connected to each floor's corridor through m motor-controlled damper. A disadvantage of the prior art system is that it thus requires two motorised dampers per floor and an expensive control system and wiring. To maintain reliability of the system, extensive maintenance and testing is required. There is therefore a need for a simpler, less expensive but effective system for venting smoke from the corridors of highrise buildings.

BRIEF DESCRIPTION OF DRAWINGS

In drawings which illustrate a preferred embodiment of the invention:

FIG. 1 is a schematic diagram showing the system of the invention in normal mode;

FIG. 2 is a schematic diagram showing the system of the invention in pressurization mode;

FIG. 3 is a schematic diagram showing the system of the invention in exhaust mode;

FIG. 4 is a schematic diagram showing the system of the invention where smoke is in the ventilation shaft;

FIG. 5 is a schematic diagram showing the system of the invention where smoke is in the corridor;

FIG. 6 is a schematic diagram showing a typical corridor layout;

FIG. 7 is a schematic diagram showing a typical central core floor plan;

FIG. 8 is a schematic diagram showing a prior art system in supply mode; and FIG. 9 is a schematic diagram showing a prior art system in exhaust mode.

SUMMARY OF INVENTION

The invention provides a method of venting smoke from a building having a plurality of floors, each floor having a plurality of suites with openable windows, each suite opening into a corridor, comprising the steps of:

a) providing a venting shaft communicating with each floor;

b) providing an air supply and exhaust grille opening into each corridor and communicating with the venting shaft;

c) providing a supply source of pressurized air, and an exhaust source of reduced pressure each communicating with the venting shaft, and damper means for selectively closing or opening the communication of the supply source of pressurized air and exhaust source of reduced pressure to the venting shaft;

d) under conditions where pressure is desired in at least one of the corridors, activating the supply source, opening the communication of the supply source to the venting shaft and closing the exhaust source communication to the venting shaft; and e) under conditions where venting of smoke or air is desired in at least one of the corridors, activating the exhaust source, opening the communication of the exhaust source to the venting shaft and closing the supply source communication to the venting shaft.

DESCRIPTION

FIGS. 8 and 9 show the prior art design for a corridor smoke venting system in a residential building. The corridor area of each floor 10, 12, 14 is equipped with a supply air grille 16 connected by vents 18 to supply air fan 20. (The grilles typically are provided with a balancing damper as shown). A motorized damper 22 controls the flow of air from the supply air fan to the supply air grille. The corridor area of each floor is also equipped with an exhaust air grille 16 connected by vents 18 to smoke exhaust fan 28. A motorized damper 24 controls the flow of air from the exhaust grille 24 to the smoke exhaust fan 26.

In the normal supply mode of the prior art system shown in FIG. 8, supply dampers 22 are open and exhaust dampers 24 are closed. Thus the supplying air will also serve to pressurize the corridor with respect to the adjoining rooms or suites, and the normal flow of air is from the supply air grille 16 through the corridor into the rooms and out of the exterior windows 30 or kitchen exhaust systems within the suites (not shown).

In the event a fire alarm is triggered, as shown in FIG. 9, the supply air fan 20 shuts down, all supply dampers 22 close and the exhaust air damper 24 on the floor where the fire is located will open to clear the corridors of smoke. The opening of the exhaust air damper 24 may be either manual or automatic. Operation is normally controlled by the fire alarm panel, sometimes called the Central Alarm and Control Facility (CACF). Air is then pulled out along the corridor by the exhaust system, which may cause some smoke to enter the corridor system if a fire is within a suite. This is problematic as it may hinder firefighters and cause additional smoke damage.

Another disadvantage of the prior art system is that it requires two motorised dampers 22, 24 per floor and an expensive control system and wiring. To maintain reliability of the system, extensive maintenance and testing is required.

The present invention is a "push/pull" venting system which provides a simpler and therefore more reliable venting system. It uses one ventilation shaft 44 for both supply and exhaust through ducts 41. A single air grille 42 with a balancing damper is provided on each floor. The supply air fan 20 and exhaust fan 28 are connected to the common ventilation shaft 44. As in the prior art system, the supply air fan remains operational under normal conditions, as shown in FIG. 1, with supply damper 43 open and exhaust damper 45 closed. The supplying air pressurizes the corridor and helps keep odours originating in one suite from migrating to the core area and other suites.

In the event of a fire in a suite, as shown in FIG. 2, the supply air continues to operate to push air into the corridor in the same way as under normal conditions. In most cases this will assist in confining the smoke to the suites to minimize damage to non-fire suites and corridors. This also assists in forcing smoke out through the exterior openings and leaks in the building exterior.

In the event of a fire in a corridor, as shown in FIG. 3, a corridor smoke detector 47 will detect the fire and sound an alarm. On activation of a corridor smoke detector, the corridor supply fan 20 will stop and the supply damper 43 closes. The exhaust damper 45 opens and the exhaust fan 28 then starts to operate to exhaust air from all floors and smoke from the corridor where the fire is located, through the same ducting 41, 44 used for supply.

The system has fire dampers 50 at each floor which remain open to exhaust all floors simultaneously, except when a high local air/gas temperature causes ther damper to close to prevent fire from spreading through the vents. The exhaust fan is sized to vent the total flow from all floors. The flow through the exhaust grilles 42 is balanced to prevent smoke from entering non-fire floors and to provide minimum flow rates for smoke exhaust. Manual controls are provided in the fire alarm panel so that firefighters may control whether to vent or pressurize the corridors depending on whether smoke in the corridor is originating in the ventilation shaft 40 (see FIG. 4) or in a suite (see FIG. 5).

The invention thus provides a system which eliminates the individually motorized damper controls at each floor level. The exhaust system can be actuated manually at the Central Alarm and Control Facility or automatically by the corridor smoke detector.

To provide an operable system according to the invention, a minimum exhaust rate must be achieved at each floor level to vent the corridors of smoke. It has been found that six air changes per hour for the corridor plus three changes per hour for the largest suite are acceptable guidelines. The supply rate is determined according to standard engineering practice to provide smoke control and normal ventilation/pressurization requirements. To achieve both pressurization and smoke venting tasks, the supply/ exhaust grilles at each floor level must be carefully selected and balanced. Grille characteristics, duct sizing, supply and exhaust fan characteristics, ambient temperatures and anticipated smoke temperatures must all be taken into account.

The forces required to open exit doors with or without the operation of the venting system must be taken into account to ensure they are nor excessive. Also the combined presence and effects of elevator and stair shafts, building leakages, smoke control systems, window breakages and door openings must be analyzed to ensure that the smoke venting system does not adversely affect the movement of smoke in the building.

For proper operation, emergency power must be provided to the fans and controls to ensure operation for a period of at least one hour in the event of a power failure. Also conductors providing power to the supply and exhaust fans must be passively protected from a fire in the floors being pressurized/vented, to survive a one hour standard fire.

Testing

Field testing of the system is necessary to ensure that the designed exhaust capacity is achieved on all floors and to confirm that the venting system does not result in adverse smoke movement. The construction of the building and most of its facilities must be substantially completed before the field testing can be meaningfully conducted. This includes the building envelope and all external windows, internal partitions including the corridors, doors, floorings including carpeting, other smoke control systems, balancing of corridor air supply and smoke exhaust system, and preferably fire alarm system and corresponding interlocks and controls.

The field tests are conducted in four groupings:

a) Functional tests

All the functional controls for fire alarms and interlocks, remote fan damper operations, automatic supply/ exhaust mode changeover, elevator controls are tested and verified.

b) Base Measurements

Pressure differentials across selected barriers within the corridor smoke venting system are measured. The measured values provide the reference data for the venting system.

c) Pressure and Flow Measurements

Pressure differentials across the same barriers as the base measurements are measured with the corridor smoke venting system running and repeated with various combinations of door and window openings. Other forms of smoke control systems, if designed to run with the corridor venting system are operated simultaneously during the measurements. The exhaust flow rates at selected points are verified.

d) Smoke Bomb tests

Smoke bombs or smoke generators are actuated at selected locations to provide a visual indication of the corridor venting system.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A method of venting smoke from a building having a plurality of floors, each floor having a plurality of suites with openable windows, at least one of said suites opening into a corridor, comprising the steps of:

a) providing a venting shaft communicating with each floor;

b) providing an air supply and exhaust grille opening into each corridor and communicating with said venting shaft;

c) providing a supply source of pressurized air, and an exhaust source of reduced pressure each communicating with said venting shaft, and damper means for selectively closing or opening the communication of said supply source of pressurized air and exhaust source of reduced pressure to said venting shaft;

d) under conditions where pressure is desired in at least one of said corridors, activating said supply source, opening said communication of said supply source to said venting shaft and closing said exhaust source communication to said venting shaft; and e) under conditions where venting of smoke or air is desired in at least one of said corridors, activating said exhaust source, opening said communication of said exhaust source to said venting shaft and closing said supply source communication to said venting shaft.

2. The method of claim 1 further comprising the steps of providing balancing dampers on each said air supply and exhaust grille and adjusting said balancing dampers to prevent passage of smoke from said venting shaft into said other corridors during step e).

* * * * *